US007712260B2

(12) United States Patent
Vardaro et al.

(10) Patent No.: US 7,712,260 B2
(45) Date of Patent: May 11, 2010

(54) ADJUSTABLE WALL SYSTEM

(75) Inventors: Enzo Vardaro, Montreal (CA); Antonio Vardaro, Montreal (CA)

(73) Assignee: Groupe Artitalia Inc., Montreal (CA)

( * ) Notice: Subject to any disclaimer, the term of this patent is extended or adjusted under 35 U.S.C. 154(b) by 1399 days.

(21) Appl. No.: 10/902,278

(22) Filed: Jul. 30, 2004

(65) Prior Publication Data

US 2006/0032186 A1 Feb. 16, 2006

(51) Int. Cl.
*E04B 2/74* (2006.01)

(52) U.S. Cl. ..... 52/36.1; 52/36.4; 52/36.6; 52/238.1; 52/239; 52/272; 52/283; 52/481.2

(58) Field of Classification Search ..... 52/36.1, 52/36.4–36.6, 238.1, 239, 272, 274, 283, 52/479, 481.2, 241, 242; 160/135, 351; 248/243, 250, 297.21, 481.1
See application file for complete search history.

(56) References Cited

U.S. PATENT DOCUMENTS

| | | | | |
|---|---|---|---|---|
| 3,820,294 | A | 6/1974 | Parker | |
| 3,986,313 | A * | 10/1976 | Nelsson | 52/481.2 |
| 4,100,709 | A | 7/1978 | Good | |
| 4,204,375 | A | 5/1980 | Good | |
| 4,434,900 | A | 3/1984 | Cook | |
| 4,567,698 | A | 2/1986 | Morrison | |
| 4,839,999 | A * | 6/1989 | Clemens et al. | 52/36.6 |
| 4,917,543 | A | 4/1990 | Cole et al. | |
| 5,024,030 | A | 6/1991 | Morrison | |
| 5,067,294 | A * | 11/1991 | McGowan | 52/241 |
| 5,069,263 | A | 12/1991 | Edwards | |
| 5,285,602 | A * | 2/1994 | Felton | 52/36.6 |
| 5,364,311 | A | 11/1994 | Chou | |
| 5,377,466 | A | 1/1995 | Insalaco et al. | |
| 5,417,020 | A | 5/1995 | Dobija | |
| 5,590,502 | A * | 1/1997 | Wendt | 52/489.2 |
| 5,634,300 | A | 6/1997 | Huebner et al. | |
| 5,644,884 | A | 7/1997 | Dobija | |
| 5,680,735 | A | 10/1997 | Bates | |
| 5,839,240 | A | 11/1998 | Elsholz et al. | |

(Continued)

FOREIGN PATENT DOCUMENTS

| | | |
|---|---|---|
| CA | 1089172 | 11/1980 |

(Continued)

*Primary Examiner*—Richard E Chilcot, Jr.
*Assistant Examiner*—Matthew J Smith
(74) *Attorney, Agent, or Firm*—Goudreau Gage Dubuc; Gonzalo Lavin

(57) ABSTRACT

An adjustable wall system comprising horizontal and vertical members for forming a frame. Panels including mounting elements for being removably mounted to two adjacent vertical members of the frame thus forming a wall run. The vertical members include protrusions to be mounted by the mounting elements. The vertical and horizontal members may be provided with mutually mating locators. Surface mounting elements are provided to be mounted to a surface, the vertical members are mounted to these elements. A region of the vertical members is exposed between adjacent panels. This region can be used to mount display members and the like thereto or be used as a spacer. Levelers are used to bolt the freestanding wall runs to the floor. Perpendicular tabs on the horizontal members are used to connect them to other horizontal members creating dividing wall runs on straight wall runs. Angular or curved brackets are used to shape the wall run accordingly.

42 Claims, 14 Drawing Sheets

U.S. PATENT DOCUMENTS

| | | | | |
|---|---|---|---|---|
| 5,864,997 | A | 2/1999 | Kelly | |
| 5,918,422 | A | 7/1999 | Bucher, Jr. | |
| 5,918,437 | A | 7/1999 | Dobija | |
| 5,974,742 | A | 11/1999 | Schreiner et al. | |
| 6,047,508 | A | 4/2000 | Goodman et al. | |
| 6,158,179 | A | 12/2000 | Ackerly et al. | |
| 6,164,467 | A | 12/2000 | DePottey et al. | |
| 6,170,211 | B1 | 1/2001 | Boyce | |
| 6,202,965 | B1 | 3/2001 | Chong | |
| 6,442,909 | B2 * | 9/2002 | Waalkes et al. | 52/239 |
| 6,446,396 | B1 | 9/2002 | Marangoni et al. | |
| 6,601,349 | B1 * | 8/2003 | Corden | 52/36.5 |
| 6,612,077 | B2 | 9/2003 | Parshad | |
| 2001/0019096 | A1 * | 9/2001 | Andreoli et al. | 248/188.8 |
| 2003/0150180 | A1 | 8/2003 | Briskman | |

FOREIGN PATENT DOCUMENTS

| | | | |
|---|---|---|---|
| EP | 0 502 736 | A2 | 9/1992 |
| JP | 2002250077 | A | 9/2002 |
| WO | WO03/085222 | A1 | 10/2003 |

* cited by examiner

ADJUSTABLE WALL SYSTEM

FIELD OF THE INVENTION

The preset invention relates to an adjustable wall system. More specifically, the present invention is concerned with a freestanding adjustable wall and area partitioning system that can be assembled and disassembled.

BACKGROUND OF THE INVENTION

Free standing and self-supporting adjustable walls are known in the art. These walls can include wan dividers and to be used to partition space in offices for example. These walls are built by assembling horizontal runners to standing vertical standards in order to form a frame and then mounting panels to this frame.

Prior art wall constructions have been proven to be difficult to assemble and disassemble especially adding or removing panels. Many of these constructions are also difficult to add auxiliary display shelves and other hardware to.

There thus remains a need for an improved adjustable wall system.

OBJECT OF INVENTION

An object of the present invention is to provide an improved adjustable wall system.

SUMMARY OF THE INVENTION

More specifically, in accordance with the present invention, there is provided an adjustable wall system comprising.

a plurality of longitudinal horizontal members;

a plurality of longitudinal vertical members, each of the vertical members comprising a mounting side being mountable to the horizontal members, and an opposite panel-receiving side; and a plurality of panels, each the panel comprising a decorative face and an opposite mounting face, the mounting face comprising mounting elements for removably mounting the panel to the panel-receiving side of the vertical members, whereby when mounting the vertical members to the horizontal members and the panels to the vertical members a wall is thus formed.

In an embodiment, the mounting elements comprise gripping elements for being clipped to the panel-receiving side of the vertical members.

In an embodiment, the clipping elements are provided near the lateral edges of the panels.

In an embodiment, the mounting elements comprise gripping elements for gripping the panel-receiving side of the vertical members.

In an embodiment, the panel gripping members comprise a resilient member and another adjacent surface.

In an embodiment, the vertical member panel-receiving side comprises a protrusion, the resilient member and the surface configured to grip the protrusion therebetween by way of the resilient member acting against the protrusion and the surface.

In an embodiment, the vertical member panel-receiving side comprises a lateral protrusion, the panel mounting face being recessed with respect to the panel decorative face exposing a backside portion of the decorative face, the exposed backside portion and a the mounting element gripping the lateral protrusion therebetween when a the panel is mounted to a the vertical member, In an embodiment, the mounting element comprises a resilient body.

In an embodiment, the mounting element extends from the panel and comprises a free end forming a shouter, the shoulder gripping the lateral protrusion against the exposed backside portion when the panel is mounted to a the vertical member.

In an embodiment, the recessed panel mounting face comprises an intrusion adjacent to the exposed backside portion, the mounting element comprising a tail end being fitted into the intrusion and an opposite free end forming a shoulder, the shoulder gripping the lateral protrusion against the exposed backside portion when the panel is mounted to a the vertical member.

In an embodiment the panel mounting face is recessed near both opposite lateral edges of a the panel, a the panel comprising mounting elements at both lateral edges thereof for being mounted to two adjacent the vertical members.

In an embodiment the panel lateral edges comprise top and bottom portions comprising restive mounting elements.

In an embodiment, the vertical member panel-receiving side comprises two opposite lateral protrusions and a central portion therebetween.

In an embodiment, the vertical member panel mounting side comprises an extension extending from the mounting side and contiguous with the two opposite lateral protrusions.

In an embodiment, a given panel is mountable to the lateral protrusions of two adjacent vertical members mounted on at least one given horizontal member.

In an embodiment, the vertical members are mounted to the horizontal members forming a frame, the panels being mounted to the vertical members in a side by side fashion thus forming a wall, each the vertical member central portion being exposed between two laterally adjacent the panels.

In an embodiment, the central portion comprises auxiliary-member-mounting elements for mounting display members thereto.

In an embodiment, the central portion comprises adjacent extending walls defining an opening therebetween, an insert being mounted within the opening, the insert comprising the auxiliary-member-mounting elements.

In an embodiment, the two lateral protrusions form a vertical channel therebetween contiguous with the central portion opening, the insert being a longitudinal member snugly fitted within the vertical channel.

In an embodiment, the auxiliary-member-mounting elements comprise sockets formed in the inserts.

In an embodiment, the auxiliary members comprise mounting elements being fitted into the sockets via the central portion opening.

In an embodiment, the auxiliary members are selected from the group consisting of display members, merchandising hardware, shelves, decorative fixtures, lights, beams, construction members and combinations thereof.

In an embodiment, the central portion comprises a closed configuration to act as a strip-spacer between adjacent panels.

In an embodiment, the adjustable wall system further comprises a leveler member for supporting the formed wall on a floor surface.

In an embodiment, the vertical members comprise respective top and bottom ends, the horizontal members comprising opposite rides and wherein when forming the wall, the bottom ends of the vertical members are mounted to both the opposite sides of a given bottom the horizontal member, the given bottom horizontal member comprising a leveler member mounting element for mounting the leveler member thereto.

In an embodiment, the leveler member comprises a pedestal and stem extending therefrom, the leveler member mounting element comprising an aperture for receiving the stem therethrough.

In an embodiment, the pedestal protrudes further than the vertical member bottom portions mounted an the both sides of the given bottom horizontal member.

In an embodiment, the protruding pedestal comprises apertures so as to be bolted to the floor surface.

In an embodiment, when the vertical members, the horizontal members, and the panels are assembled to form the wall, the wall comprises a top most horizontal member and bottom most horizontal member, horizontal rows of side by side panels, and wall-edge vertical members at each lateral end of the wall.

In an embodiment, the adjustable wall system further comprises a longitudinal top cap covering the top most horizontal member.

In an embodiment, the adjustable wall system according further comprises a baseboard cover for covering space between the floor surface and the bottom most the row of panels.

In an embodiment, the adjustable wall system further comprises longitudinal end caps for covering the and wall-edge vertical members at each lateral end of the wall.

In an embodiment, the horizontal members comprise longitudinal ends configured to receive corner bracket members for forming a corner between one assembled wall and another assembled wall.

In an embodiment, the corner brackets comprise a curved configuration.

In an embodiment, the corner brackets comprise an angular configuration.

In an embodiment, the panels comprise corner panels, the corner panels comprising a configuration corresponding to the configuration of the corner brackets.

In an embodiment, a given vertical member mounting side comprises laterally extending leg members comprising fastening elements. In an embodiment these fastening elements comprise apertures.

In an embodiment, a given horizontal member comprises corresponding fasteners corresponding to the vertical member fastening elements. In an embodiment, these corresponding fasteners comprise apertures.

In an embodiment, the vertical member mounting side comprises locators.

In an embodiment, the horizontal members comprise corresponding-locators for corresponding to the vertical member mounting side locators.

In an embodiment, the horizontal member comprises a tab extending therefrom for mounting another the horizontal member thereto thus providing for building a divider wall on a formed wall.

In an embodiment, the tab is substantially perpendicular to the length of the given horizontal member.

In an embodiment the horizontal members comprise respective longitudinal ends configured to be mounted to similarly constructed horizontal members.

In an embodiment, the vertical members comprise respective top and bottom end configured to be mounted to similarly constructed horizontal members.

In an embodiment, when the panels are mounted to the vertical members forming a wall run, a region of the panel-receiving face is exposed between two adjacent panels.

In an embodiment, this region comprises auxiliary-member mounting elements for receiving auxiliary members.

In an embodiment, this region comprises a spacer.

In accordance with another aspect of the present invention, there is provided an adjustable wall system comprising:

a frame comprising plurality of free standing vertical members mounted along their longitudinal lengths to a plurality of horizontal members along both sides of the longitudinal lengths of the horizontal members; and wall-runs comprising a plurality of panels mounted to the frame, the panels comprising mounting elements near the lateral edges thereof for being mounted on two adjacent the vertical members, wherein when the panels are mounted to the vertical members they expose a region of a the vertical member between two adjacent panels.

In an embodiment, the exposed region comprises auxiliary-member mounting elements for mounting auxiliary members thereto In an embodiment, the auxiliary members are selected from the group consisting of display members merchandising hardware, shelves, decorative fixtures, lights, beams, construction members and combinations thereof.

In an embodiment, this exposed region comprises a spacer.

In an embodiment, the adjustable wall system further comprised a plurality of wall runs.

In an embodiment, this at least one the wall run is in a substantially perpendicular relationship to another the wall run.

In an embodiment, the wall run comprises a straight configuration.

In an embodiment, the wall run comprises an angular configuration.

In an embodiment the wall run comprises a curved configuration.

In an embodiment, the horizontal members and the vertical members comprise respective mutually mating locators.

In accordance with a further aspect of the present invention there is provided an adjustable wall system comprising:

a plurality of longitudinal horizontal members, a plurality of longitudinal vertical members for being mounted to the horizontal members, each of the vertical members comprising a panel-receiving members; and a plurality of panels, each the panel comprising a gripping elements near the edge thereof for being removably mounted to the panel-receiving elements of two adjacent the vertical members.

In an embodiment, the panel gripping members compose a resilient member and another adjacent surface.

In an embodiment, the vertical member panel-receiving members comprise a protrusion the resilient member and the surface configured to grip the protrusion therebetween by way of the resilient member acting against the protrusion and the surface.

In an embodiment, when the panels are mounted to the vertical members a region defined by the vertical members is exposed between to adjacent panels.

In an embodiment, them exposed region comprises auxiliary-member mounting elements for mounting auxiliary members thereto.

In an embodiment, the auxiliary members are selected from the group consisting of display members merchandising hardware, shelves, decorative fixtures, lights, beams, construction members and combinations thereof, In an embodiment, the exposed region comprises a spacer.

In an embodiment, horizontal members and the vertical members comprise respective mutually mating locators In accordance with yet a further aspect of the present invention there is provided an adjustable wall system comprising:

a plurality of longitudinal vertical members, each of the vertical members comprising a mounting side for being mountable to a surface and an opposite panel-receiving side; and a plurality of panels, each the panel comprising comprising mounting elements for removably mounting the panel to the panel-receiving side of the vertical members, whereby when mounting the vertical members to the horizontal members and the panels to the vertical members a wall is thus formed.

In an embodiment, the adjustable wall system further comprises surface-mounting elements mountable to a surface, the vertical members mountable to the surface mounting elements.

In an embodiment, the vertical member comprises a mounting side for mounting to the surface-mounting elements, a the vertical member mounting side and a the surface mounting element comprising respective mutually mating locators.

In an embodiment, the surface mounting element comprises a Z-formed clip comprising a surface mounting portion and a vertical member mounting portion.

In an embodiment, the vertical members comprising a panel-receiving members.

In an embodiment, the panel-receiving members comprise protrusions.

In an embodiment, the panel mounting elements comprise a resilient member and another adjacent surface for fitting therebetween a the panel-receiving member when the panel is mounted to a the vertical member, the resilient member being biased against the panel-receiving member and towards the adjacent surface.

In an embodiment, the adjacent-surface is a shoulder formed by the panel and the panel-receiving members comprise lateral protrusions.

In an embodiment, the panel mounting elements comprise an element selected from the group consisting of clipping elements and gripping elements.

In an embodiment, when the panels are mounted to the vertical members a region defined by the vertical members is exposed between two adjacent panels.

In an embodiment, the exposed region comprises auxiliary-mounting elements for mounting auxiliary members thereto.

In an embodiment, the auxiliary members are selected from the group consisting of display members merchandising hardware, shelves, decorative fixtures, lights, beams, construction members and combinations thereof.

In an embodiment, the exposed region comprises a spacer.

In an embodiment, the surface being mounted by the vertical member comprises a wall surface.

In accordance with yet another aspect of the present invention there is provided a longitudinal vertical member for an adjustable wall system comprising a backing surface for mounting the vertical member thereto and panels mountable to the vertical members for forming a wall when assembled, the vertical member comprising:

a mounting side for being mounted to the backing surface; and a panel-receiving side opposite the mounting side comprising panel-receiving protrusions and a central portion therebetween.

In an embodiment, the panel-receiving protrusions is opposite lateral protrusion extending from a main body of the vertical member.

In an embodiment, the main body extends from the mounting side.

In an embodiment, the protrusions receive respective panels.

In an embodiment, the central portion is exposed when the respective panels are mounted thereto.

In an embodiment, the exposed central portion comprises auxiliary-member receiving elements for receiving an auxiliary member.

In an embodiment, the exposed central portion comprises a spacer.

In an embodiment, the backing surface comprises a surface selected from the group consisting of a wall, a horizontal member, a surface-mounting element and a combination thereof.

In an embodiment, the vertical member further comprises locators for being mounted a predetermined area of the backing surface.

In accordance with still another aspect of the present invention there is provided a panel for mounting to an adjustable wall system comprising a frame comprising vertical members mounted to a backing surface the panel comprising:

opposite faces, lateral edges and top and bottom ends:

at least one mounting element mounted to one the face near at least one the later edge;

a surface formed at the one face and being adjacent to the mounting element;

wherein the mounting element is so biased towards the adjacent surface as to wedge a portion of the frame therebetween when mounting the panel to the frame.

In an embodiment, this portion of the frame is a portion of the vertical member.

In an embodiment, the vertical member portion comprises a protrusion.

In an embodiment, the mounting element extends from the panel and comprises a free end forming a shoulder.

In an embodiment the panel further comprises an intrusion, the mounting element comprising a tail end being fitted into the intrusion.

In an embodiment, the panel further comprises mounting elements at both the lateral edges thereof.

In an embodiment, the panel further comprises mounting elements near both the top and bottom ends.

In an embodiment, the backing surface comprises a surface selected from the group consisting of a wall, a horizontal member, a surface-mounting element and a combination thereof.

Other objects advantages and features of the present invention will become more apparent upon reading of the following non restrictive description of embodiments thereof, given by way of example only with reference to the accompanying drawings.

BRIEF DESCRIPTION OF THE DRAWINGS

In the appended drawings where like elements are referenced by like reference numerals and in which.

DESCRIPTION OF THE EMBODIMENT

With reference to the appended drawings an embodiment of the invention will be herein described so as to exemplify the invention and not limit its scope.

Figure 1:
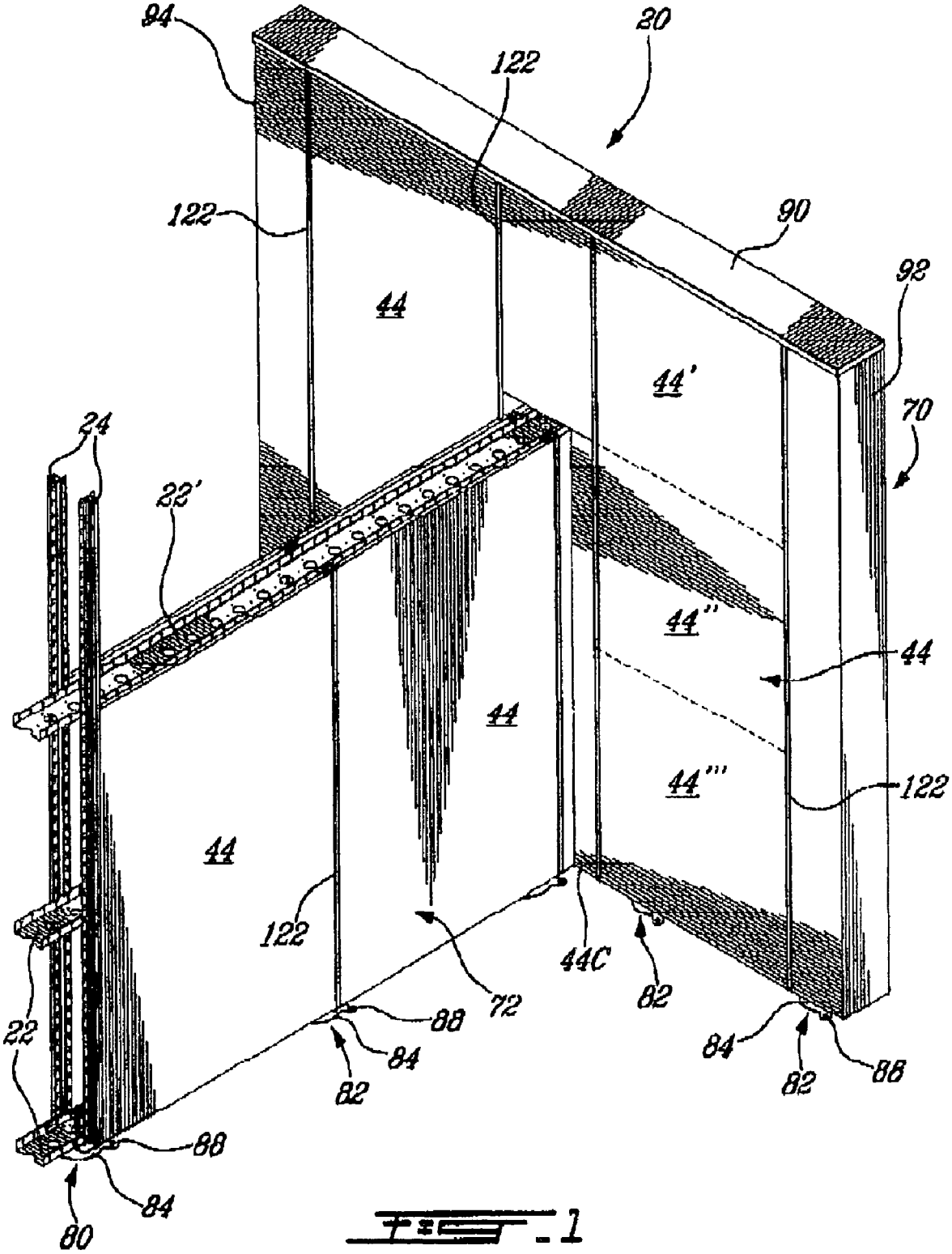
FIG. 1 is a perspective view of an assembled adjustable wall system in accordance with an embodiment of the present invention.
Figure 2:
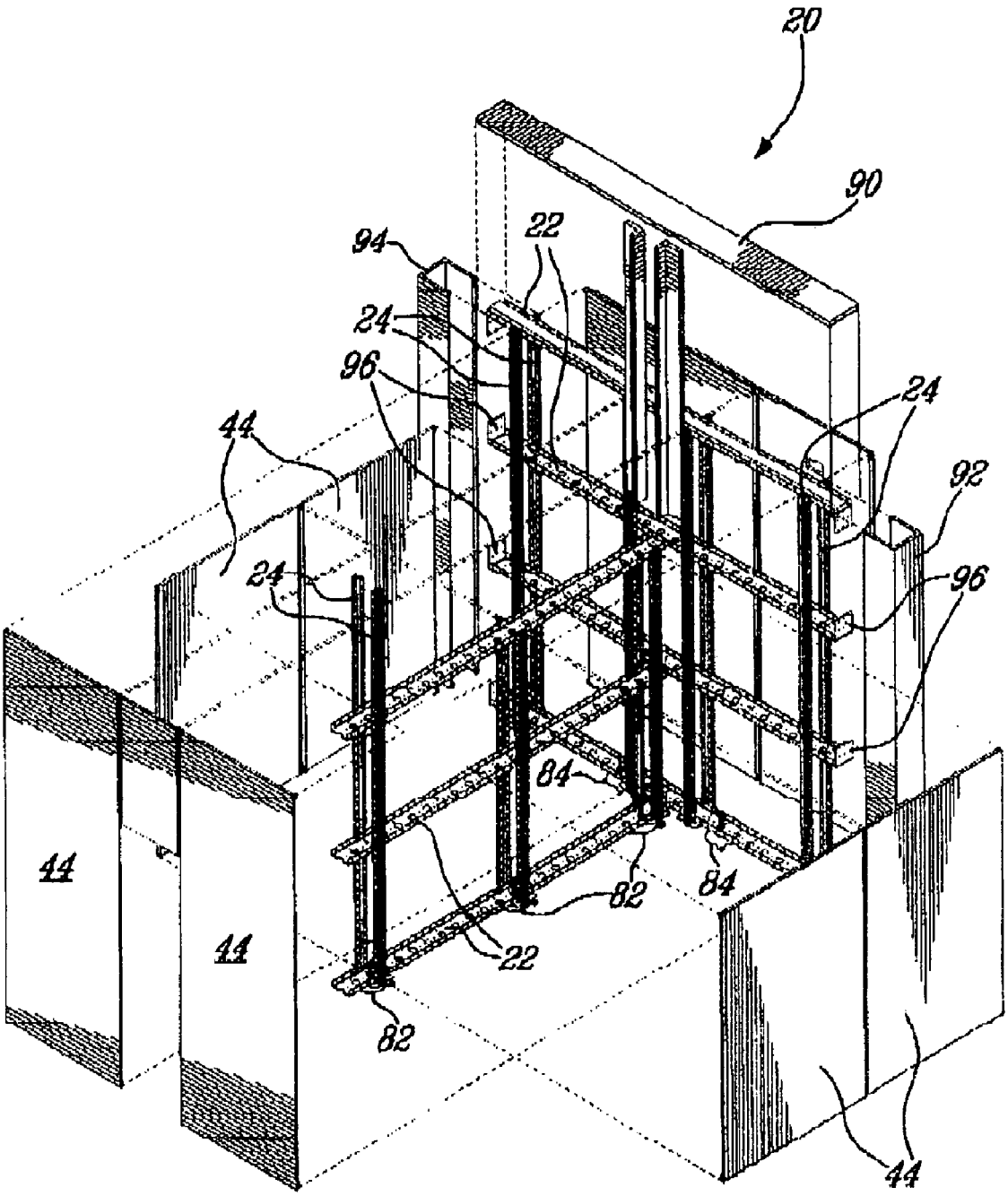
FIG. 2 is a perspective of the adjustable wall system of FIG. 1 being partially disassembled.
Figure 14:
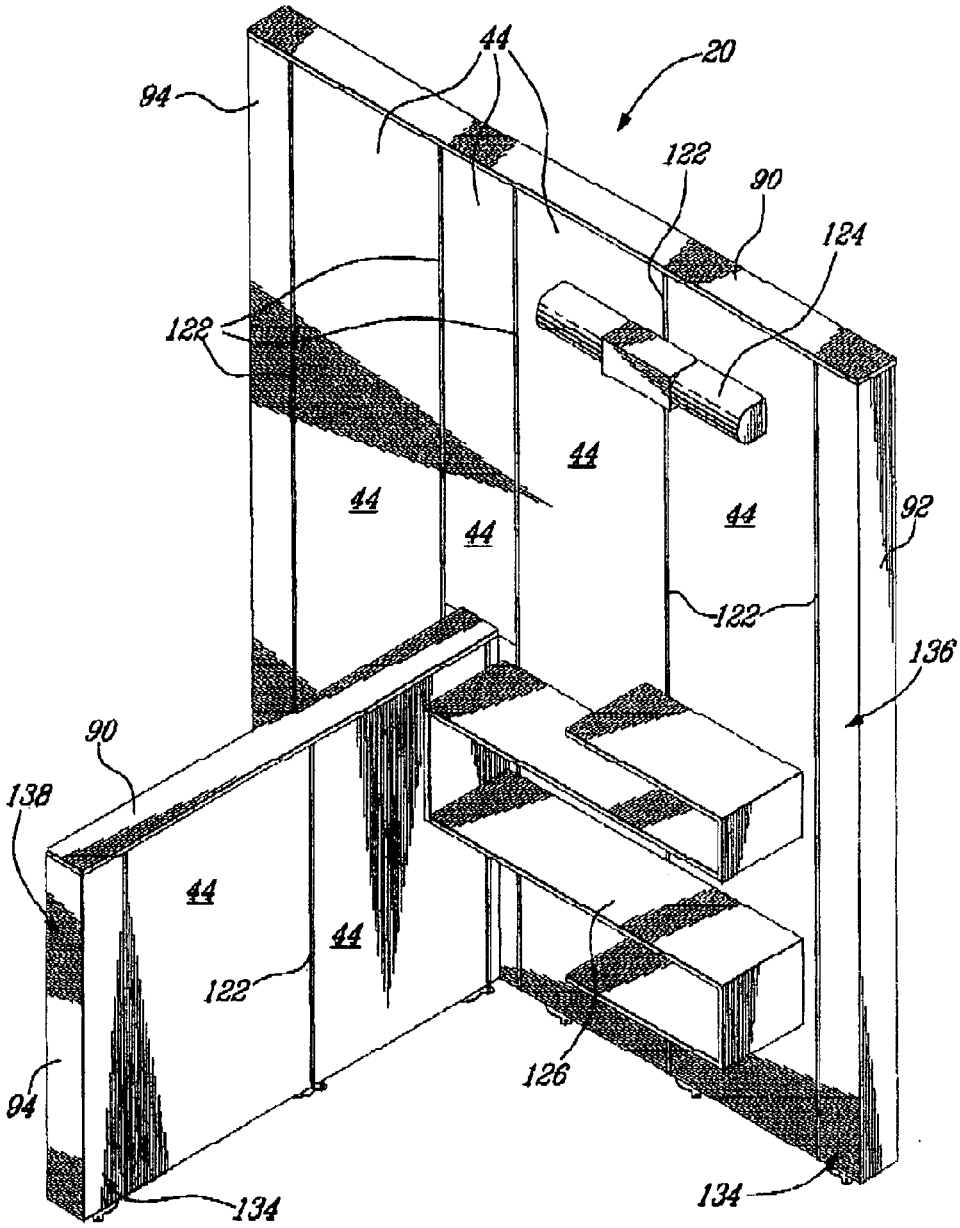
FIG. 14 is a perspective view of the of an ambled adjustable wall system including auxiliary elements in accordance with an embodiment of the present invention.

FIGS. 1, 2 and 14 show an adjustable wall system in accordance with an embodiment of the invention.

Figure 3:
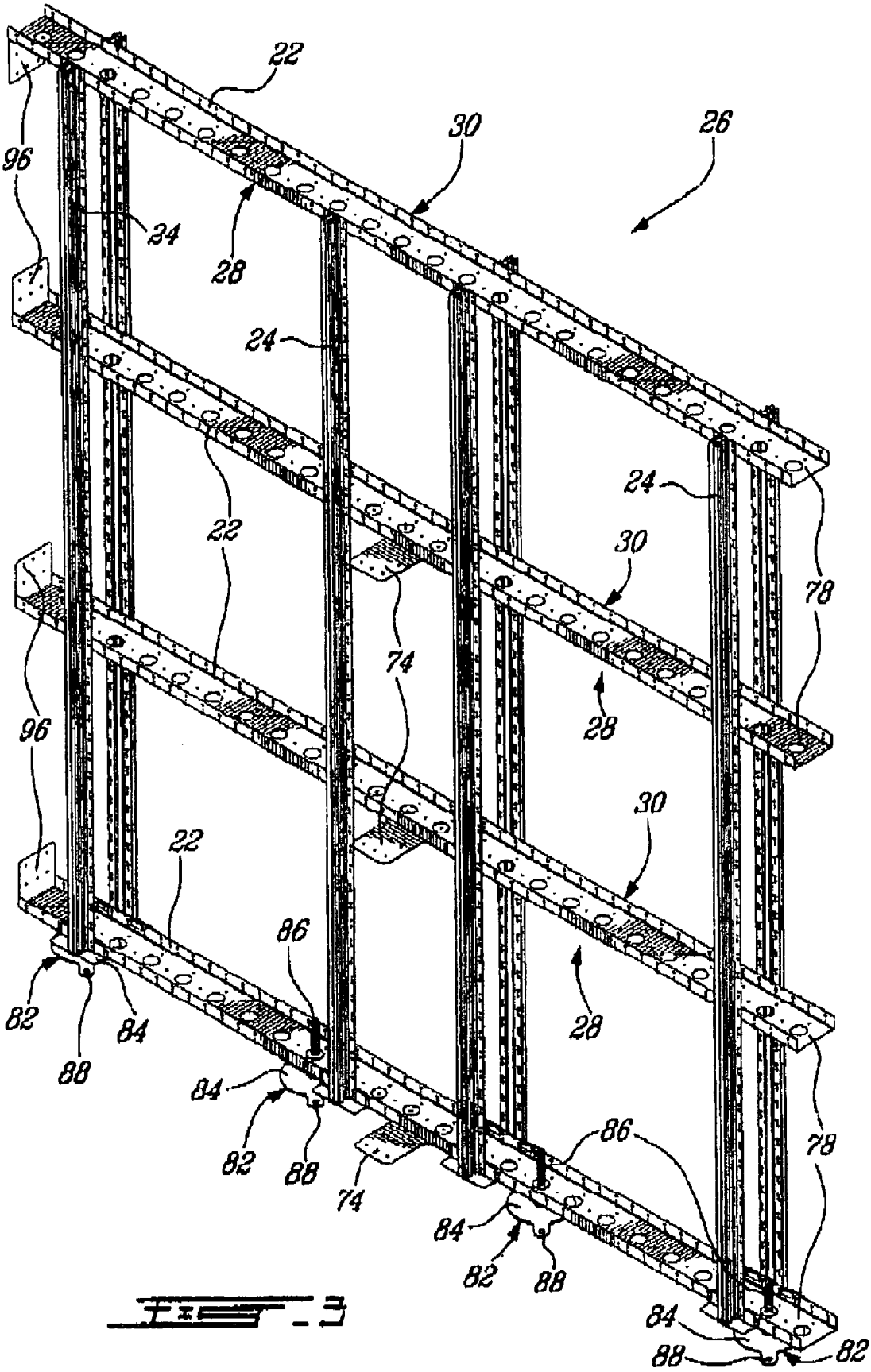
FIG. 3 is a perspective view of the wall frame of the present invention in accordance with an embodiment thereof.

With reference to FIGS. 1, 2 and 3 the adjustable wall system 20 induces a plurality of horizontal members 22 in the form of longitudinal runners having mounted thereto vertical members 24 in the form of longitudinal vertical standards, thus forming a frame 26 (see FIG. 3).

Referring to FIG. 3, the horizontal runners 22 include opposite longitudinal sides 28 and 30 for mounting the vertical standards 24 thereto.

Figure 4:
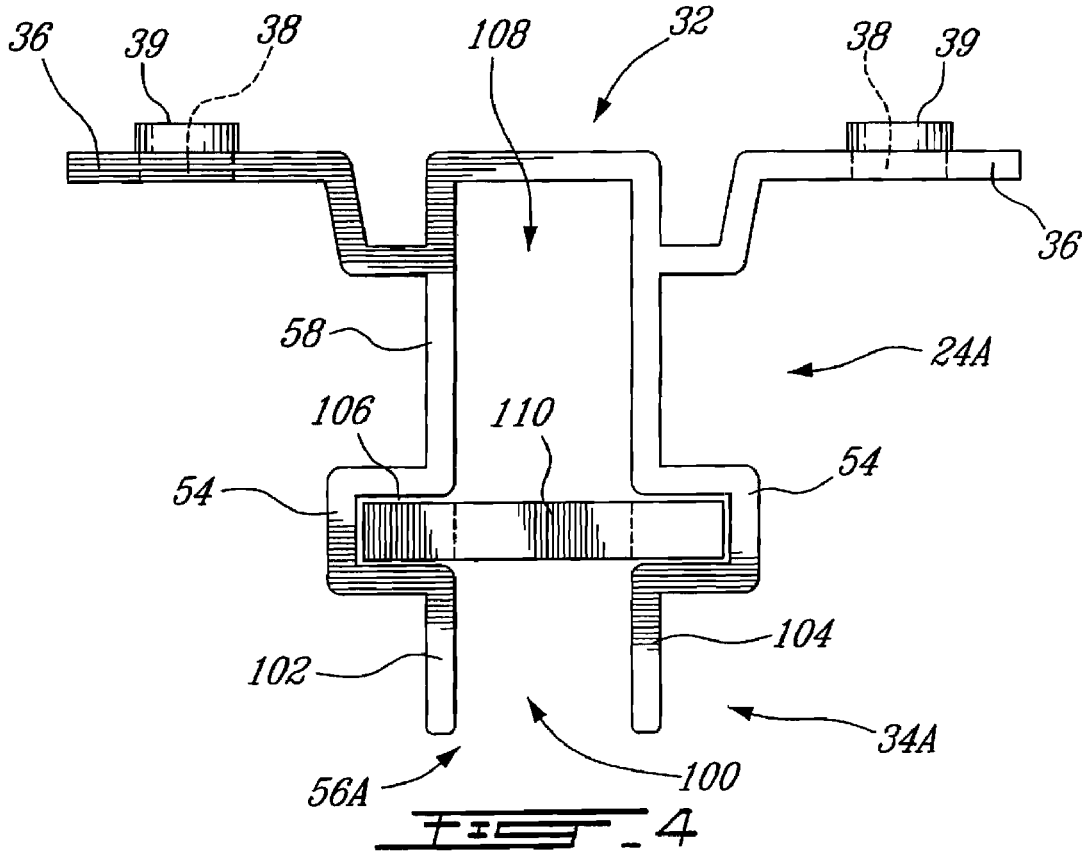
FIG. 4 is a top view of the vertical member of the present invention in accordance with an embodiment thereof.
Figure 5:
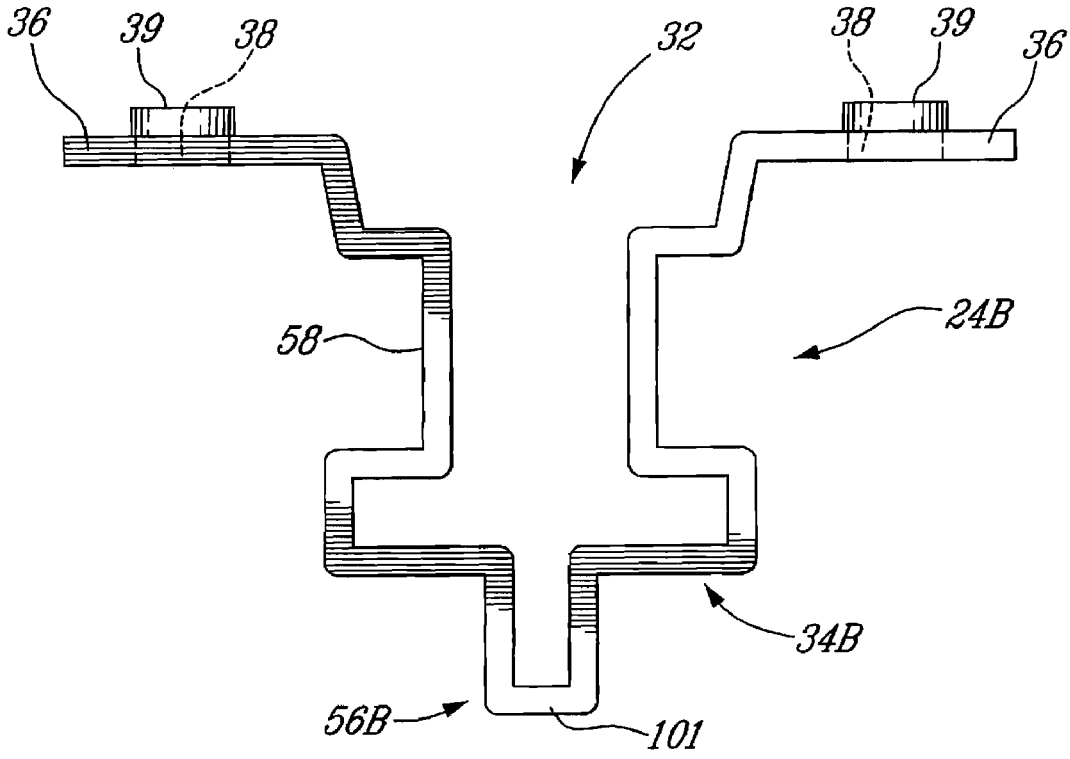
FIG. 5 is a top view of the vertical member of the present invention in accordance with another embodiment thereof.

With respect to FIGS. 4 and 5, there are shown two non-limiting embodiments of the vertical standards 24A and 24B respectively. Both vertical standard embodiments 24A and 24B include a mounting side 32 and respective panel-receiving sides 34A and 34B. The mounting side 32 includes laterally extending leg members 36 including fastening elements 38 and locators 39. As better shown in FIGS. 6 and 7, these fastening elements 38 are apertures to be aligned with corresponding apertures 40 on a given side 28 of the horizontal runner 22 so as to bolt the vertical member 24 to a given horizontal runner 22 via fastening elements 42, such as bolts. Furthermore, to facilitate assembly of the vertical standards 24 to the horizontal runners 22 this, locators 39 are mated with horizontal member locators 41. Locator 39 are in the form of protrusions, while locators 41 are in the form or corresponding apertures. As shown, the sides 28 and 30 are wall members upwardly extending from a base floor 29.

Returning to FIGS. 1 and 2, the adjustable wall assembly includes a plurality of panels 44, which are removably mounted to the vertical standards 24.

Figure 6:
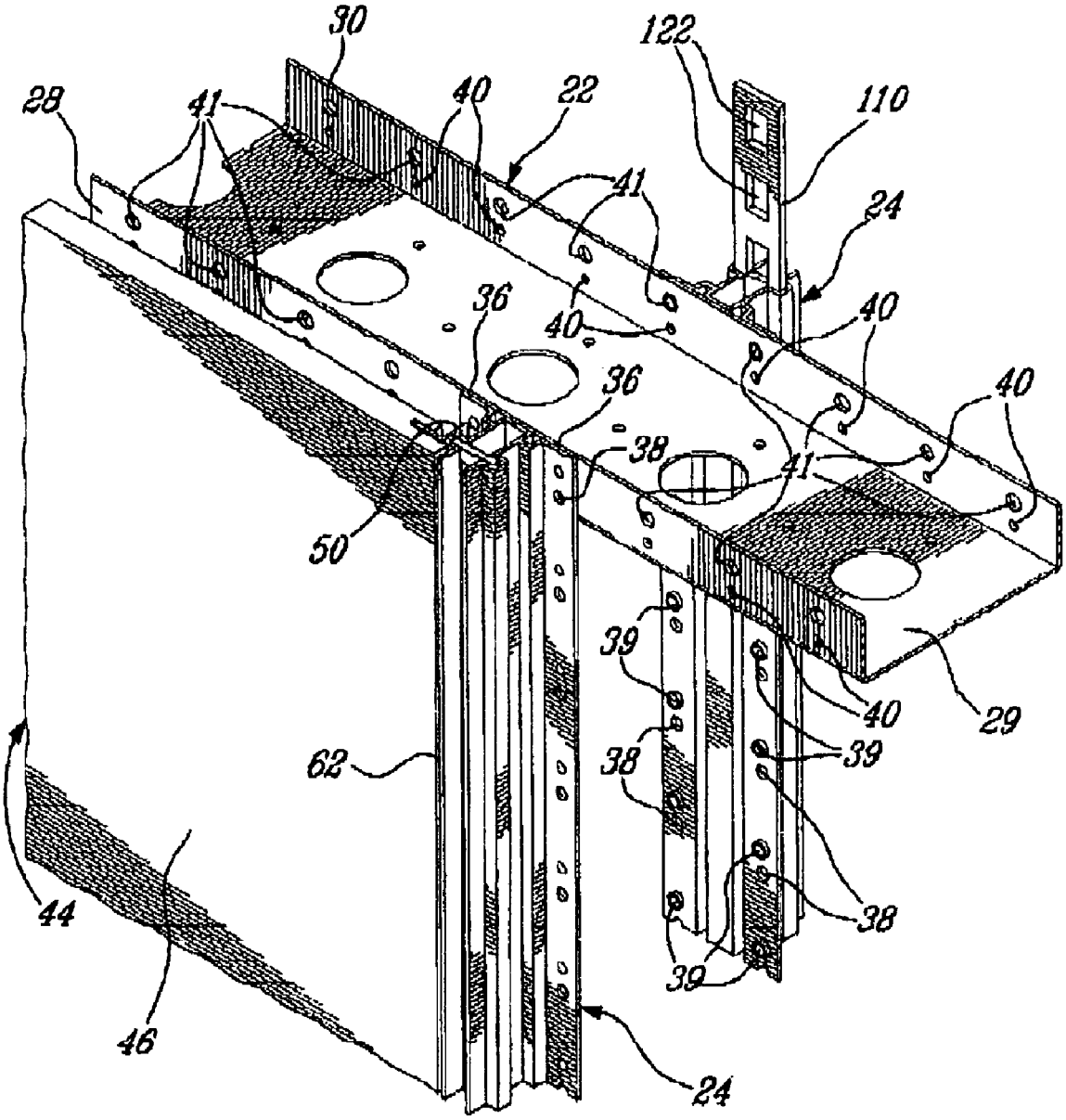
FIG. 6 is a partial perspective view of a panel mounted to the wall frame of the present invention in accordance with another embodiment thereof.
Figure 7:
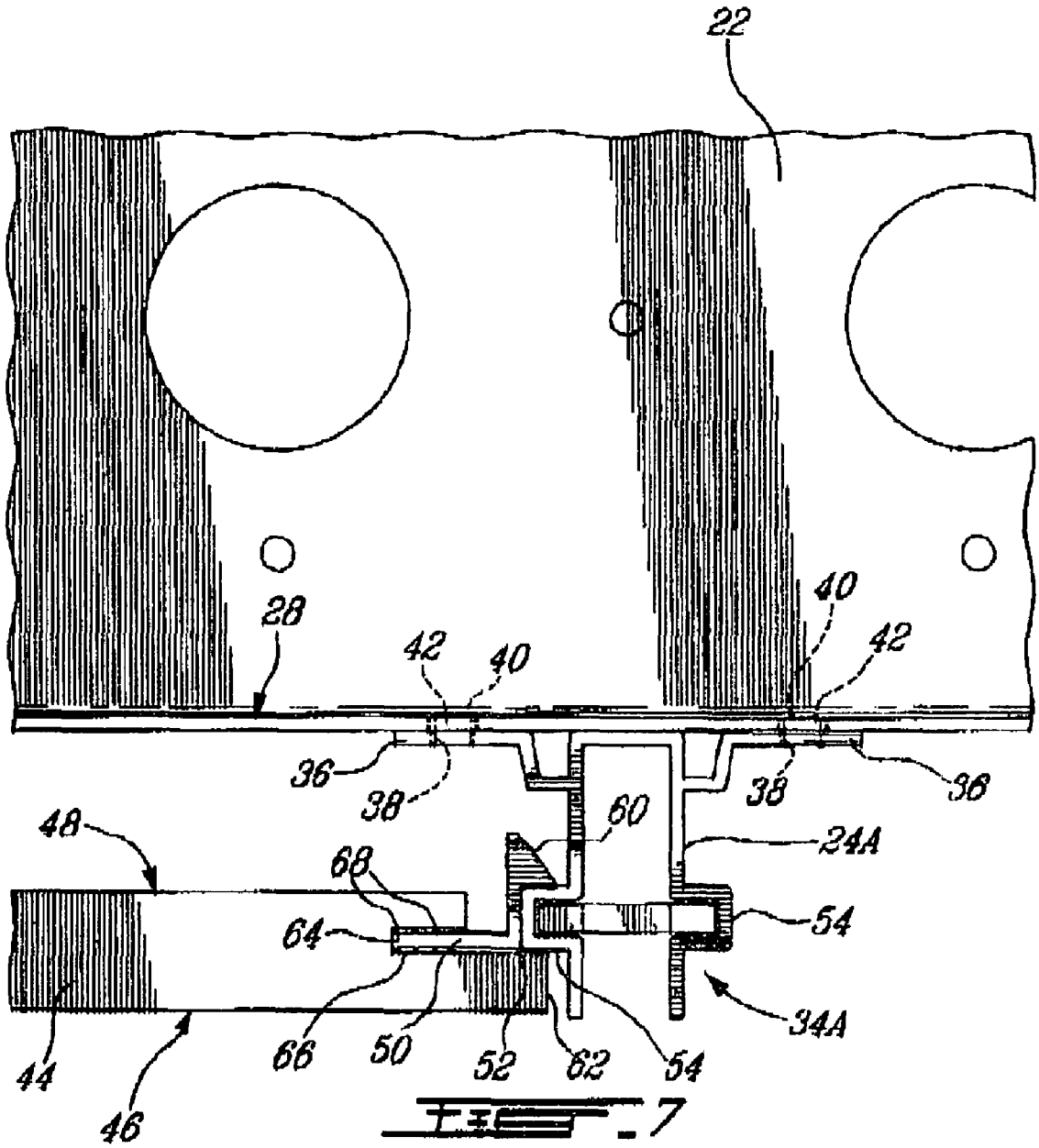
FIG. 7 is a top partial view of a panel mounted to the vertical member of the present invention in accordance with another embodiment thereof.

With particular reference to FIGS. 6 and 7, panel 44 includes a front or outer decorative face 46 and on opposite mounting face 48 which includes a mounting element 50 for mounting the panel 44 to the panel-receiving side 34 of a giver vertical member 24. As shown, the mounting face 48 is recessed and exposes a backside portion 52 of the decorative face. As will be explained herein, this backside portion 52 acts as a ripping shoulder.

Turning back to FIGS. 4 and 5, the panel-receiving sides 34A and 34B of the vertical standards 24A and 24B include lateral protrusions 54 formed by extruded aluminum, for example, and a central portion 56A (for vertical standards 24A, and 56B (for vertical standard 24B). Also, as shown, the vertical standards 24A and 24B include a main body 58 that extends away from the mounting side 32.

Turning again to FIG. 7, the mounting element 50 is in the form of a resilient clip member extending from the panel 44 and having a free end that forms a shoulder 60. Hence, resilient shoulder 60 and backside portion shoulder 52 grip a lateral protrusion 54 therebetween by way of shoulder 60 acting against lateral protrusion 54. The panel members 44 include such mounting elements 50 near both their lateral edges 82 (see FIGS. 6 and 7) and in this way, they are removably mounted in a snap fashion between two adjacent vertical members 24. Furthermore, the mounting clip 50 includes a tail portion 64 that is fitted into an intrusion 66 formed in the panel 44 and adjacent to the backside portion 52. This tail portion 64 includes teeth 68 for being wedged in intrusion 66.

Returning to FIGS. 1 and 2, the wall system 20 provides for a straight wall 70 to be divided by a divider wall 72. In this embodiment, the divider wall 72 is substantially perpendicular to the straight wall 70. In this respect, and turning to FIGS. 8 and 9, the horizontal runners 22 include tabs 74 substantially perpendicular thereto. These tabs include fastening elements 76 such as apertures for being mounted to a similarly constructed vertical runner 22' (see FIGS. 1 and 9).

Figure 8:
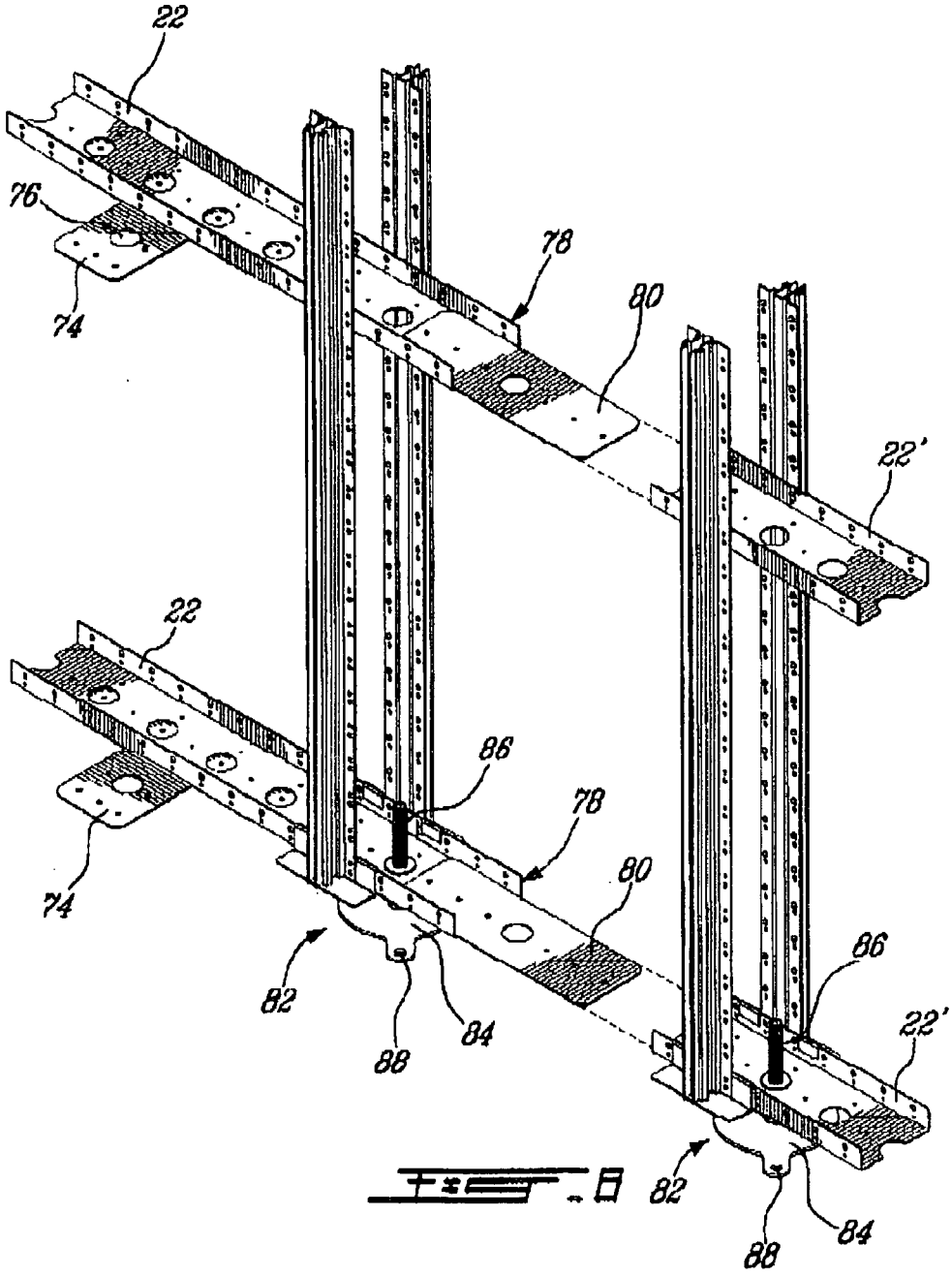
FIG. 8 is a partial perspective view of a the wall frame showing the tabs, horizontal extensions and the levelers of the of the present invention in accordance with an embodiment thereof.
Figure 9:
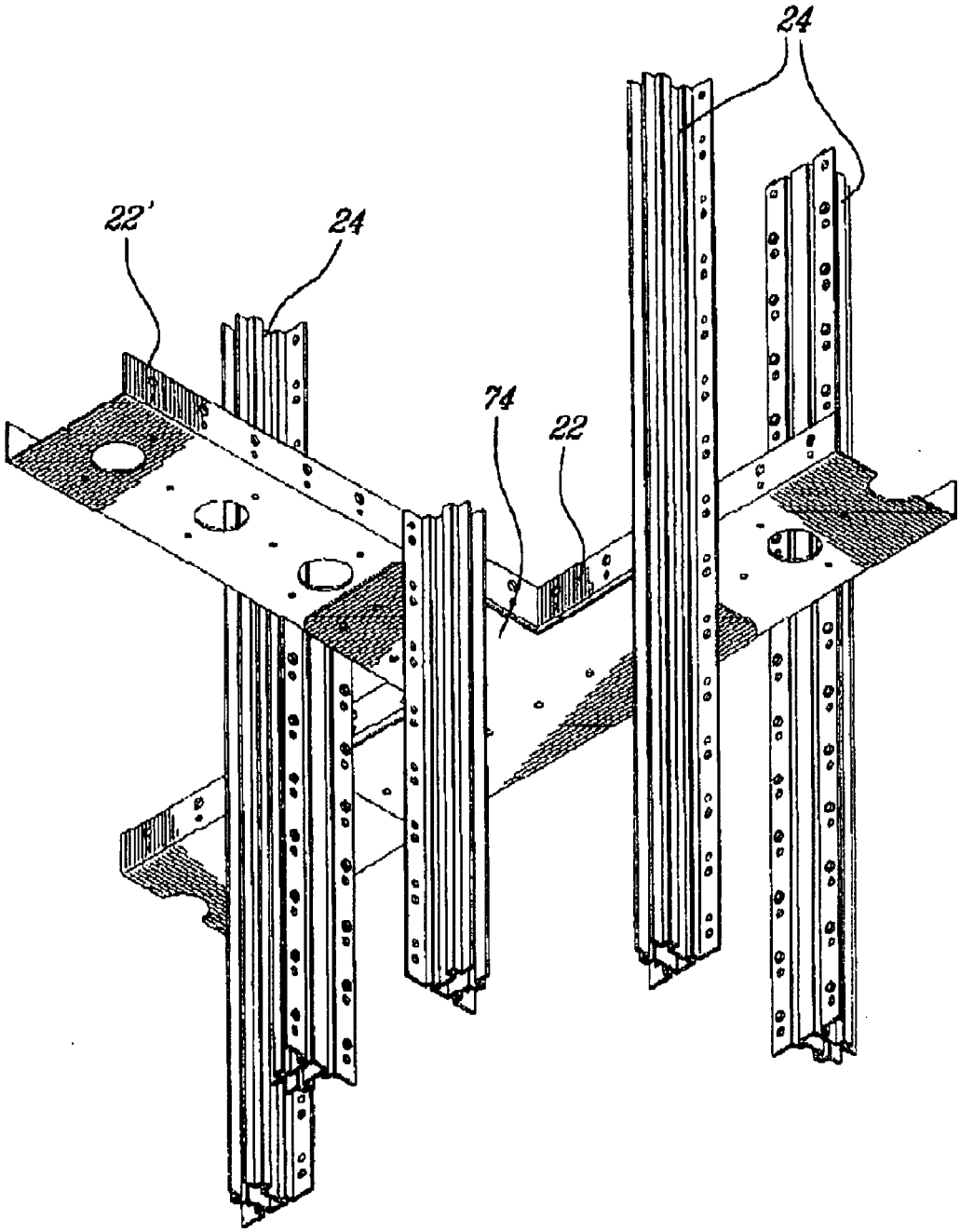
FIG. 9 is bottom partial perspective view of the frame showing a horizontal member being substantially perpendicularly mounted to another horizontal member in accordance with an embodiment of the present invention.

With reference to FIG. 8, the horizontal runners 22 include longitudinal ends 78 which are configured to receive similarly constructed horizontal members 22' in order to extend a wall run, for example. In this respect, an extension element 80 can be used to mount to horizontal runners 22 and 22' together.

Referring generally to FIGS. 1 and 2 and particularly to FIGS. 3 and 8, the adjustable wall system 20 also includes a leveler member 82. The leveler member 82 includes a pedestal 84 from which extends a stem 86 that is connected to the lowermost horizontal member 22. The pedestal 84 protrudes from both sides of the walls 70 and 72 (as shown in FIG. 1 and more clearly in FIGS. 10, 11, and 12) and includes an aperture 88 so as to be bolted on the floor. The leveler 82 provides for stability of the freestanding walls 70 and 72.

With reference to FIGS. 1, 2, and 14 the adjustable wall system 20 also includes a longitudinal top cap 90 for capping off the uppermost horizontal runner 22.

Furthermore, the adjustable wall system 20 includes longitudinal end caps 92 and 94 for covering the vertical members 24 that are near the edges of the wall and a portion of the horizontal runners 22 which protrude beyond the vertical standards at the ends of the frame 26. In this respect horizontal runners 22 can be provided with longitudinal end cap connectors 96.

Figure 10:
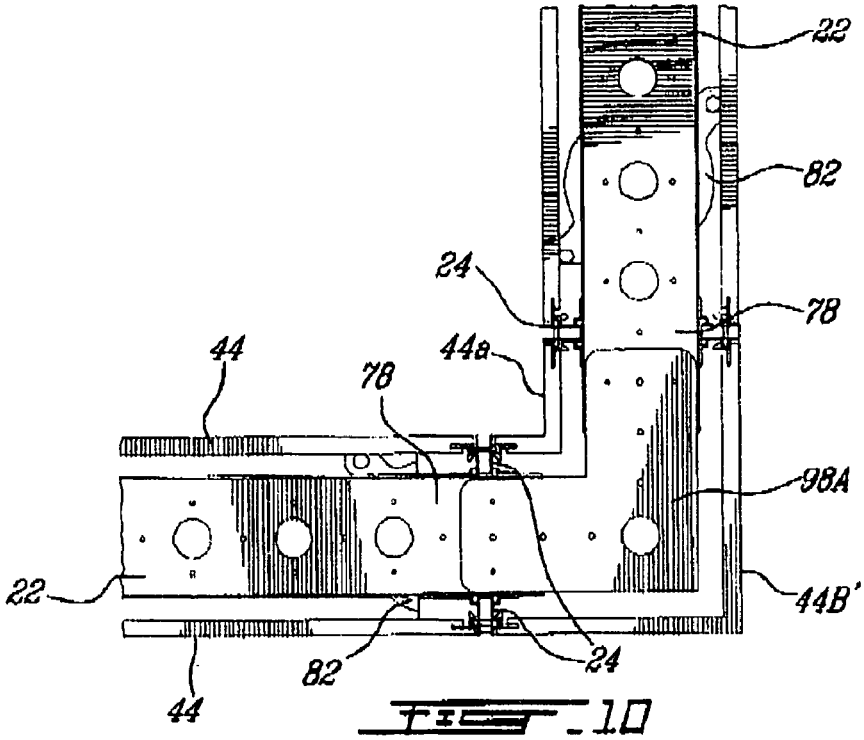
FIGS. 10, 11 and 12 are top views of the corner brackets of the present invention in accordance with three respective embodiments thereof.
Figure 11:
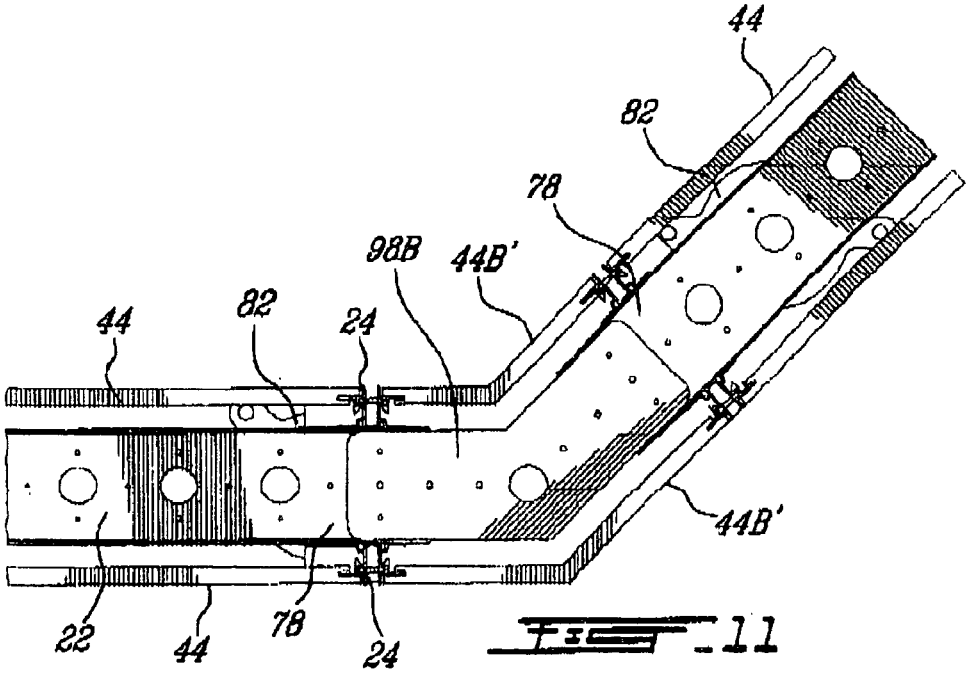
Figure 12:
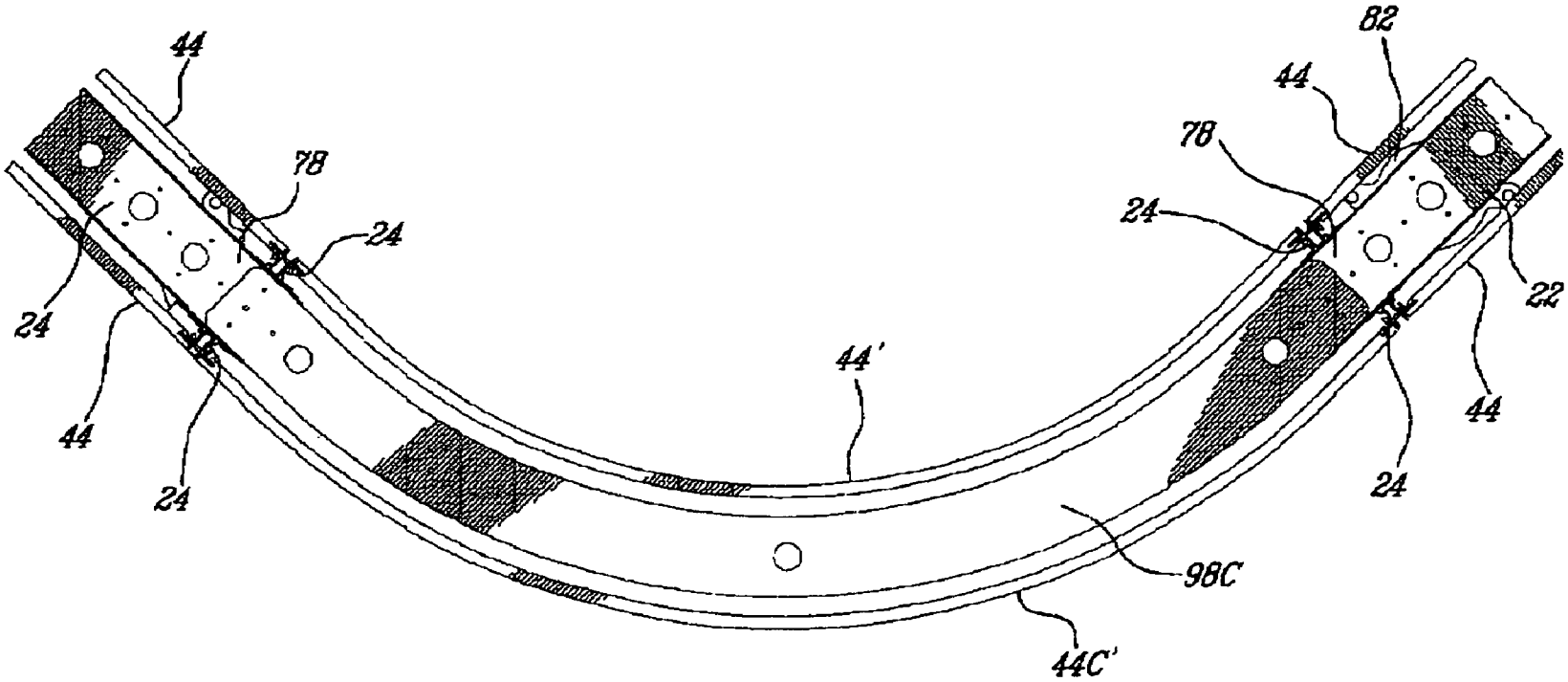

Turning now to FIGS. 10, 11, and 12, the longitudinal ends 78 of the horizontal runners 22 are configured to receive a corner bracket member configured to create a corner such as corner bracket members 98A, 98B, and 98C, which are shown in FIGS. 10, 11, and 12 respectively and which form 90° angles, 45° angles, and a curved configuration respectively. Of course, corresponding panels are used to cover the longitudinal corners of a wall defined by the foregoing brackets such as 44A, 44A' in FIG. 10, 44B, and 44B' in FIG. 11, and 44C, and 44C' in FIG. 12.

Figure 13:
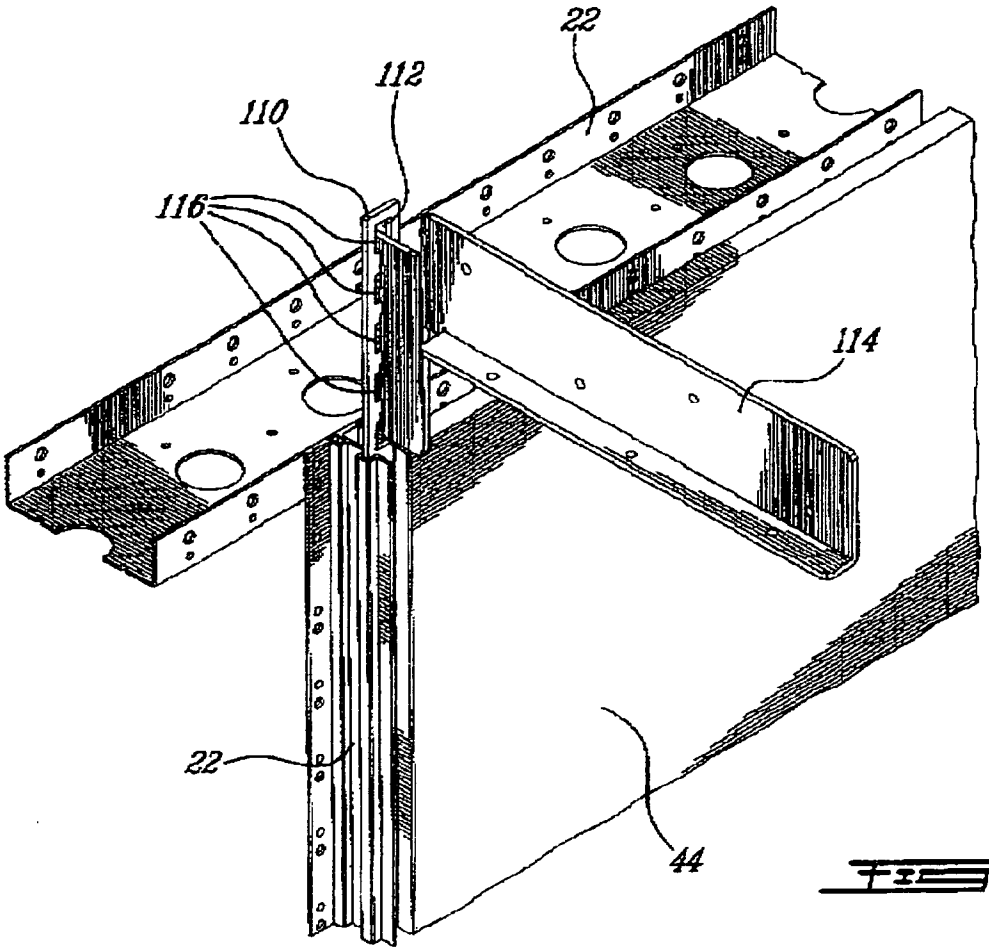
FIG. 13 is a partial perspective view of a panel and an auxiliary member mounted to the frame in accordance with an embodiment of the present invention.
Figure 15:
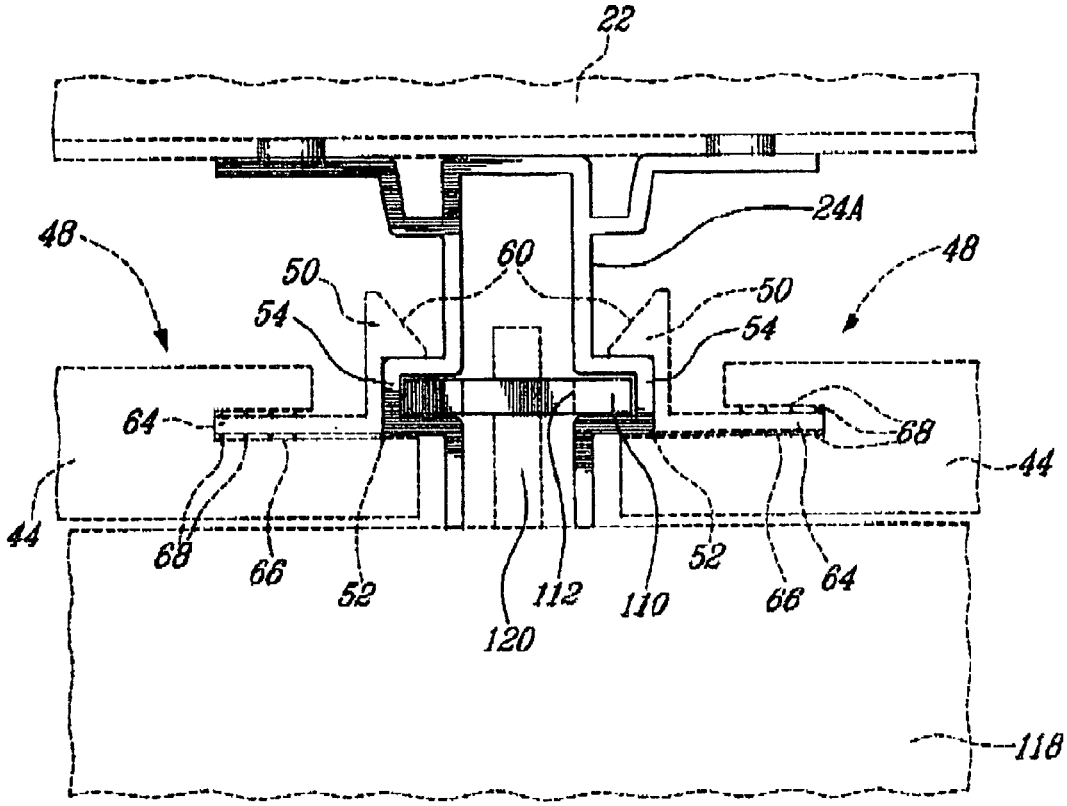
FIG. 15 is a top view of two panels and an auxiliary element mounted to the vertical member in accordance with an embodiment of the present invention.

With reference to FIGS. 4 and 15, the vertical standard 24A includes the central portion 56A of its panel-mounting side 34A that is open, this opening 100 is defined by two opposite extending wall members 102 and 104. This opening 100 provides access to a channel 106 that is defined by the extruded lateral longitudinal protrusions 54 and the open area 108 defined by the main body 58. Channel 106 is configured to snugly receive therein an insert 110 therein. As shown in FIG. 13, the insert 110 is socketed and hence, includes a plurality of sockets and/or apertures 112 for receiving an auxiliary element 114 in the form of a beam in this example. As shown in FIG. 13, the insert 110 protrudes beyond the vertical standard 22. In this way, the beam 114 includes mounting elements 116 in order to be hooked into the sockets 112 of socket insert 110. Turning to FIG. 15, an auxiliary, element 118 shown including a mounting element 120 in order to be fitted into the socket 112 of the insert 110. Hence, as shown in FIG. 14, the present adjustable wall system provides for exposed regions 122 defined by the vertical standards 24 between panels 44 for attaching thereto a variety of auxiliary elements such as a lamp 124 or a shelving member 126 and the like.

Referring to FIG. 5, the vertical standard 34B includes a panel-mounting side 34B with a central portion 56B that is closed, hence, when the panels 44 are mounted onto the frame 26, as shown in FIGS. 1 and 14, the exposed regions 122 are accent-strip spacers between the panels.

Figure 16A:
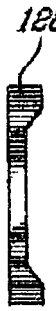
FIGS. 16A, 16B and 16C are lateral elevation views of three baseboards in accordance with three respective embodiments of the present invention.
Figure 16B:
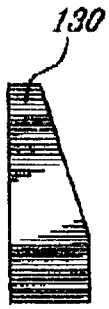
Figure 16C:
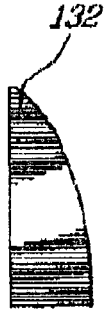

With reference to FIGS. 16A, 16B, and 16C, a variety of baseboards 128, 130, and 132 are respectively provided. These baseboards 128, 130, and 132 can be used to cover the bottom portion 134, as shown in FIG. 14 of wall runs 136 and 138. In an alternative embodiment, the panel, as shown in FIG. 1, is made up of 3 smaller sectional panels 44', 44", 44'", and it is possible that the lowermost panel 44'" is spaced from the floor exposing the lowermost horizontal runner 22. In this case, the baseboards will be used to cover this opening. The baseboards may be provided in a variety of embodiments, for example, baseboard 128 has a concave moulding, baseboard 130 has a slanted moulding, baseboard 132 has a curved moulding. Of course, standard rectangular mouldings can also be provided as well as other types of suitable and decorative mouldings.

Figure 17:
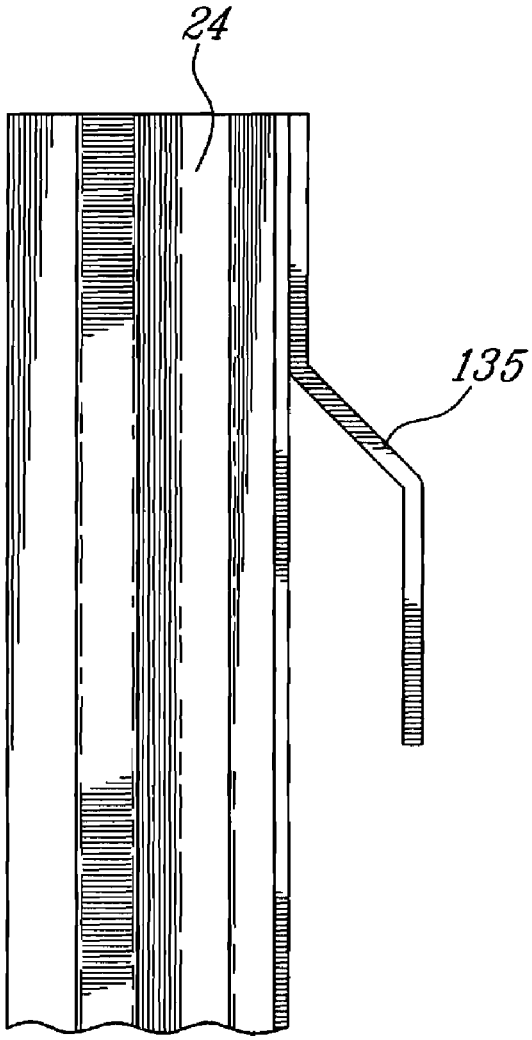
FIG. 17 is a lateral elevation view of a Z clip mounted to a vertical member in accordance with an embodiment of the present invention.

With reference to FIG. 17, there is shown a vertical standard 24 and a surface mounting element, in the form for a metal Z-clip 134 to exemplify one non-limiting embodiment, that is secured onto the vertical standard 24 to act as reinforcement to existing standard sheet rock walls, for example. Hence, vertical standard 24 is mounted to a vertical member receiving portion via fastener (not shown) by aligning their respective apertures to receive the fastener (screw, bolt etc.). A vertical member locator 39 is aligned with a corresponding locator (not shown) on the Z-clip 134 to facilitate mounting.

Figure 18:
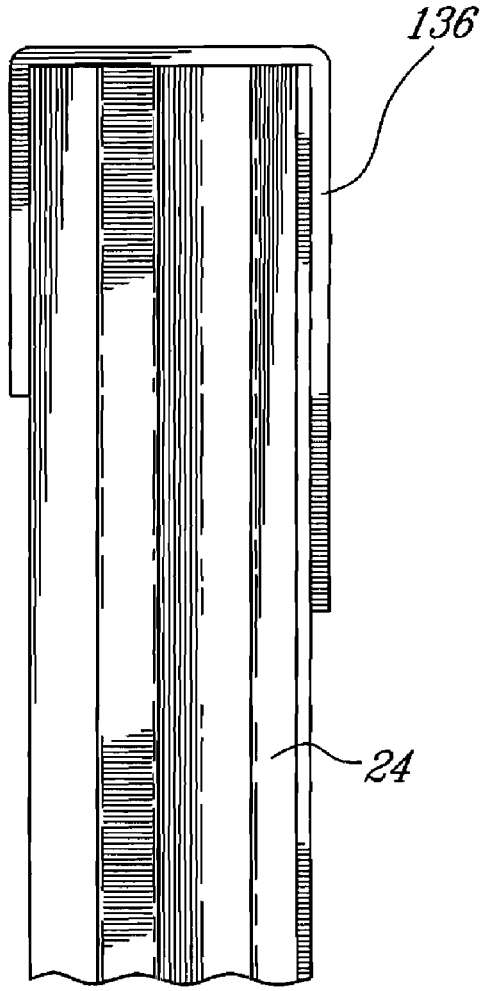
FIG. 18 is a lateral elevation view of a J channel mounted to a vertical member in accordance with an embodiment of the present invention.

FIG. 18 shows a top or bottom metal J channel member 136 which can be used to align the vertical standards 24, securing them to standard cinder block perimeter walls, for example.

In operation, the vertical standards 24 will be mounted on both sides 28 and 30 of the horizontal runners 22. Hence, vertical standards 24 are mounted along the longitudinal length of the horizontal runners 22, and horizontal runners 22 are mounted along the longitudinal length of the vertical standards 24, thus forming the frame 26.

As shown in FIG. 2, a divider frame can divide a straight frame via perpendicularly mounting horizontal runners to other horizontal runners via the use of tabs 74. Levellers 84 can be used in order to stabilize the frame 26 onto the floor, as well as to bolt the frame onto the floor thus creating a stable and freestanding wall. As aforementioned, the wall runs need not to be straight and can be provided in a variety of configurations via the corner brackets such as corner brackets 94, 98A, 98B, 98C, and other corner brackets that can be contemplated by a skilled artisan within the scope of the present invention. Once the wall frame 26 of the desired configuration has been built, panels 44 can be dipped to the vertical standards 24 exposing a region 122 of these vertical standards 24 that, in one embodiment, can be used as accent spacers (see embodiment 24B of FIG. 5) or can be used as auxiliary mounting elements (see embodiment 24A of FIG. 4). In this last embodiment, a variety of auxiliary mounting elements, such as those shown in FIGS. 13, 14, and 15, can be mounted to various wall runs.

Therefore, the adjustable wall system can be used to provide a variety of partitions, wall spaces for office areas or walls for displaying merchandise, and the like.

Using the surface mounting element 135 a wall can be built on a wall surface.

These walls are freestanding and can be extended, rearranged or adjusted in any way, as described hereinabove.

Having now described an embodiment of the present invention, various other embodiments, which are within the scope of the invention, will be described herein without limitation thereto, and only to further exemplify the present invention and not limit the scope thereof.

The horizontal members 22 may be in a variety of forms. They may be made by a series of shorter longitudinal runners that can be mounted to each other or a variety of telescoping runners that can be locked at certain lengths.

The vertical members 24 can be mounted to the horizontal members 22 by a variety of ways known to the skilled artisan. In the embodiment of an open vertical member 24, such as vertical member 24A, the apertures 112 for receiving auxiliary elements of a variety of sorts can be directly built within the vertical standard. Of course, the vertical member 24 need not have a central portion that protrudes outwardly in order to be used either as an auxiliary member mounting element or a spacer, as described hereinabove, and as such, the laterally protruding elements 54 may flank a flat central region 56 that is not exposed when panels 44 are mounted thereto. In this case, the lateral edges of two adjacent panels 44 will abut each other. The lateral protrusions 24 may be provided in a variety of suitable configurations in order to provide for a panel to be mounted thereto, as described herein.

A variety of locators 39 and 41, known to one having skill in the art, to facilitate mating the horizontal members with the vertical members can be provided within the scope of the present invention.

The horizontal and vertical members 22 and 24 and a frame 26 can be provided in a variety of suitable materials, as will be understood by one having skill in the art.

The horizontal members 22 can also be mounted to another surface such as a wall and hence comprise surface mount elements. In this regard, the surface mounting elements 135 comprise any element that can be mounted to a surface and that can receive the vertical members 24 of the present invention.

Panels 44 can be provided in a variety of shapes and configurations for designing various wall runs, as is known in the art. Of course, the decorative faces 46 can be provided in a variety of colours and allures depending on the taste and preferences of the user. Panels 44 can also be provided in a variety of suitable materials such as wood, plastic, various cushion materials, metal, and the like. Again, this will depend on the taste and preferences of the user. A variety of mounting elements can be used in order to mount the panels 44 onto adjacent vertical members 24. Such mounting elements include magnets or various resilient members that may grip or clip the vertical member 24 with the aid of a shoulder created by the panel members, as described herein. Of course, in another embodiment, the lateral protrusions may include sockets, and the panels may include hook members to be connected to these sockets.

Therefore, the adjustable wall system described herein and claimed in the appended claims provides a variety of adjustable wall runs for partitioning spaces such as offices, or using the walls for merchandising or displaying other display members. The adjustable wall can therefore be assembled and disassembled or adjusted according to need by extending or shortening it horizontally and/or vertically by adding or removing auxiliary members, by adding or removing divider walls by adding or removing corners.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention as defined in the appended claims.

What is claimed is:

1. An adjustable wall system comprising:

a plurality of longitudinal horizontal members;

a plurality of longitudinal vertical members, each of said vertical members comprising a mounting side being mountable to said horizontal members, and an opposite panel-receiving side; and a plurality of panels, each said panel comprising a decorative face and an opposite mounting face, said mounting face comprising mounting elements for removably mounting said panel to said panel-receiving side of said vertical members, whereby when mounting said vertical members to said horizontal members and said panels to said vertical members a wall is thus formed, wherein said vertical member panel-receiving side comprises a lateral protrusion, said panel mounting face being recessed with respect to said panel decorative face exposing a backside portion, said exposed backside portion and a said mounting element gripping said lateral protrusion therebetween when a said panel is mounted to a said vertical member; wherein a said mounting element extends from said panel and comprises a free end forming a shoulder, said shoulder gripping said lateral protrusion against said exposed backside portion when said panel is mounted to a said vertical member and wherein said recessed panel mounting face comprises an intrusion adjacent to said exposed backside portion, said mounting element comprising a tail end being fitted into said intrusion and an opposite free end forming a shoulder, said shoulder gripping said lateral protrusion against said exposed backside portion when said panel is mounted to a said vertical member.

2. An adjustable wall system according to claim 1, wherein said mounting elements comprise clipping elements for being clipped to said panel-receiving side of said vertical members.

3. An adjustable wall system according to claim 2, wherein said clipping elements are provided near the lateral edges of said panels.

4. An adjustable wall system according to claim 1, wherein said mounting elements comprise gripping elements for gripping said panel-receiving side of said vertical members.

5. An adjustable wall system according to claim 1, wherein said mounting element comprises a resilient body.

6. An adjustable wall according to claim 1, wherein said panel mounting face is recessed near both opposite lateral edges of a said panel a said panel comprising mounting elements at both lateral edges thereof for being mounted to two adjacent said vertical members.

7. An adjustable wall according to claim 6, wherein said panel lateral edges comprise top and bottom portions comprising respective mounting elements.

8. An adjustable wall awarding to claim 1, wherein said vertical member panel-receiving side comprises two opposite lateral protrusions and a central portion therebetween.

9. An adjustable wall according to claim 8, wherein said vertical member panel mounting side comprises an extension extending from said mounting side and contiguous with said two opposite lateral protrusions.

10. An adjustable wall according to claim 8, wherein a given said panel is mountable to said lateral protrusions of two adjacent vertical members mounted on at least one given horizontal member.

11. An adjustable wall according to claim 10, wherein said vertical members are mounted to said horizontal members forming a frame, said panels being mounted to said vertical members in a side by side fashion thus forming a wall, each said vertical member central portion being exposed between two laterally adjacent said panels.

12. An adjustable wall system according to claim 11, wherein said central portion comprises auxiliary-member-mounting elements for mounting display members thereto.

13. An adjustable wall system according to claim 12, wherein said central portion comprises adjacent extending walls defining an opening therebetween, an insert being mounted within said opening, said insert comprising said auxiliary-member-mounting elements.

14. An adjustable wall system according to claim 13, wherein said two lateral protrusions form a vertical channel therebetween contiguous with said central portion opening, said insert being a longitudinal member snugly fitted within said vertical channel.

15. An adjustable wall system according to claim 14, wherein said auxiliary-member-mounting elements comprise sockets formed in said inserts.

16. An adjustable wall system according to claim 15, wherein said auxiliary members comprise mounting elements being fitted into said sockets via said central portion opening.

17. An adjustable wall system according to claim 11, wherein said auxiliary members are selected from the group consisting of display members, merchandising hardware, shelves, decorative fixtures, lights, beams, construction members and combinations thereof.

18. An adjustable wall system according to claim 8, wherein central portion comprises a closed configuration to act as a strip-spacer between adjacent panels.

19. An adjustable wall system according to claim 1, further comprising a leveler member for supporting the formed wall on a floor surface.

20. An adjustable wall system according to claim 19, wherein said leveler member comprises a pedestal and stem extending therefrom, said leveler member comprising an aperture for receiving said stem therethrough.

21. An adjustable wall system according to claim 20, wherein said pedestal comprises apertures so as to be bolted to the floor surface.

22. An adjustable wall system according to claim 1, wherein when said vertical members, said horizontal members, and said panels are assembled to form the wall, said wall comprises a top most horizontal member and bottom most horizontal member, horizontal rows of side by side panels, and wall-edge vertical members at each lateral end of the wall.

23. An adjustable wall system according to claim 22 further comprising a longitudinal top cap covering said top most horizontal member.

24. An adjustable wall system according to claim 22, further comprising a baseboard cover for covering space between the floor surface and the bottom most said row of panels.

25. An adjustable wall system according to claim 22, further comprising longitudinal end caps for covering said wall-edge vertical members at each lateral end of the wall.

26. An adjustable wall system according to claim 1, wherein said horizontal members comprise longitudinal ends configured to receive corner bracket members for forming a corner between one assembled wall and another assembled wall.

27. An adjustable wall system according to claim 26, wherein said corner brackets comprise a curved configuration.

28. An adjustable wall system according to claim 26, wherein said corner brackets comprise an angular configuration.

29. An adjustable wall system according to claim 26, wherein said panels comprise corner panels, said corner panels comprising a configuration corresponding to the configuration of said corner brackets.

30. An adjustable wall system according to claim 1, wherein a given said vertical member mounting side comprises laterally extending leg members comprising fastening elements.

31. An adjustable wall system according to claim 30, wherein said fastening elements comprise apertures.

32. An adjustable wall system according to claim 30, wherein a given said horizontal member comprises corresponding fasteners corresponding to said vertical member fastening elements.

33. An adjustable wall system according to claim 32, wherein said corresponding fastener comprise apertures.

34. An adjustable wall system according to claim 1, wherein said vertical member mounting side comprises locators.

35. An adjustable wall system according to claim 34, wherein said horizontal members comprise corresponding-locators from corresponding to said vertical member mounting side locators.

36. An adjustable wall system according to claim 1, wherein a said horizontal member comprises a tab extending therefrom for mounting another said horizontal member thereto thus providing for building a divider wall on a formed wall.

37. An adjustable wall system according to claim 36, wherein said tab is substantially perpendicular to the length of said given horizontal member.

38. An adjustable wall system according to claim 1, wherein said horizontal members comprise respective longitudinal ends configured to be mounted to similarly constructed horizontal members.

39. An adjustable wall system according to claim 1, wherein said vertical members comprise respective top and bottom ends configured to be mounted to similarly constructed horizontal members.

40. An adjustable wall system according to claim 1, wherein when said panels are mounted to said vertical members forming a wall run, a region of said panel-receiving side is exposed between two adjacent panels.

41. An adjustable wall system according to claim 40, wherein said region comprises auxiliary-ember mounting elements for receiving auxiliary members.

42. An adjustable wall system according to claim 40, wherein said region comprises a spacer.

* * * * *